US011241779B2

(12) United States Patent
Webster

(10) Patent No.: US 11,241,779 B2
(45) Date of Patent: Feb. 8, 2022

(54) POWER TOOL

(71) Applicant: WEBSTER TECHNOLOGIES LIMITED, Sheffield (GB)

(72) Inventor: Ian Webster, Sheffield (GB)

(73) Assignee: Webster Technologies Limited, Sheffield (GB)

( * ) Notice: Subject to any disclaimer, the term of this patent is extended or adjusted under 35 U.S.C. 154(b) by 22 days.

(21) Appl. No.: 16/071,415

(22) PCT Filed: Mar. 20, 2017

(86) PCT No.: PCT/GB2017/050773
§ 371 (c)(1),
(2) Date: Jul. 19, 2018

(87) PCT Pub. No.: WO2017/163037
PCT Pub. Date: Sep. 28, 2017

(65) Prior Publication Data

US 2019/0176313 A1 Jun. 13, 2019

(30) Foreign Application Priority Data

Mar. 21, 2016 (GB) ..... 1604758

(51) Int. Cl.
*B25D 17/06* (2006.01)
*B25D 17/24* (2006.01)

(52) U.S. Cl.
CPC ..... *B25D 17/06* (2013.01); *B25D 17/24* (2013.01); *B25D 2216/0015* (2013.01);
(Continued)

(58) Field of Classification Search
CPC ..... B25D 17/06; B25D 17/24; B25D 2216/0015; B25D 2216/0046;
(Continued)

(56) References Cited

U.S. PATENT DOCUMENTS 2,436,450 A 2/1948 Price
3,010,431 A 11/1961 Holdo
(Continued)

FOREIGN PATENT DOCUMENTS

GB 191116380 7/1912
GB 0236910 A 6/1925
(Continued)

OTHER PUBLICATIONS

International Search Report and Written Opinion PCT/GB2017/050773, dated Sep. 28, 2017.

*Primary Examiner* — Robert F Long
*Assistant Examiner* — Xavier A Madison
(74) *Attorney, Agent, or Firm* — TannerIP PLLC; Daniel A. Tanner, III; James E. Golladay, II

(57) ABSTRACT

A power tool is provided that includes a tool carrier for mounting an impact tool. The tool carrier has a base member aligned with an operational axis. The base member has a head end for receiving impact energy, a foot end provided with a tool mount configured to transmit the impact energy to the impact tool, and a casing engagement feature between the head end and foot end. A first casing module is provided with a tool carrier engagement feature complementary in shape to, and for interlocking engagement with, the tool carrier casing engagement feature to prevent rotation of the tool carrier relative to the first casing module around the operational axis, and permits relative movement between the tool carrier and the first casing module along the operational axis.

25 Claims, 14 Drawing Sheets

(52) U.S. Cl.
CPC ..... *B25D 2216/0046* (2013.01); *B25D 2217/0019* (2013.01); *B25D 2217/0073* (2013.01); *B25D 2222/57* (2013.01); *B25D 2250/121* (2013.01)

(58) Field of Classification Search
CPC .... B25D 2217/0019; B25D 2217/0073; B25D 2222/57; B25D 2250/121
USPC ..... 173/201
See application file for complete search history.

(56) References Cited

U.S. PATENT DOCUMENTS

| | | | | |
|---|---|---|---|---|
| 3,244,241 | A | 4/1966 | Ferwerda | |
| 3,312,293 | A | 4/1967 | Cutler | |
| 3,797,584 | A * | 3/1974 | Bailey | E21B 6/00 173/105 |
| 3,938,427 | A | 2/1976 | Warrington | |
| 4,106,573 | A * | 8/1978 | Bailey | B25D 17/084 173/106 |
| 4,984,640 | A | 1/1991 | Gillan et al. | |
| 5,407,017 | A | 4/1995 | Wehr et al. | |
| 6,089,330 | A * | 7/2000 | Miescher | B25D 17/005 173/104 |
| 7,438,138 | B2 * | 10/2008 | Andersson | B25D 16/00 173/131 |
| 2008/0006418 | A1 * | 1/2008 | Berghauser | B25D 17/06 173/20 |
| 2008/0190632 | A1 | 8/2008 | Berger et al. | |
| 2013/0206436 | A1 | 8/2013 | Thorson et al. | |

FOREIGN PATENT DOCUMENTS

| | | | |
|---|---|---|---|
| GB | 2375319 | A | 11/2002 |
| JP | 56-167022 | A | 12/1981 |
| JP | 2013144346 | A | 7/2013 |
| WO | 1991/010542 | A1 | 7/1991 |
| WO | 1995/002093 | A2 | 1/1995 |
| WO | 00/41851 | A1 | 7/2000 |
| WO | 2004/029400 | A1 | 4/2004 |

* cited by examiner

POWER TOOL

BACKGROUND

Pneumatic drills for cutting masonry are well known. Typically they incorporate a weight which is raised against gravity by a hydraulic ram and when the weight has been raised to the desired extent, the weight is allowed to fall under gravity to strike a drill bit, delivering an impact force to a masonry target.

FIG. 1 shows an alternative power tool as described in GB2375319B (BACA Limited). The tool 1 comprises a cuboid structural casing 2 to carry upper handles 4,6, and a work piece 8 in the form of a chisel. Inside, and further supported by, the casing there is a hydraulic ram 10 mounted through a platform 12. The ram comprises a cylinder 14 and a piston 16. Mounted onto a moving platform 18 there is a body 20 in the form of a heavy weight. Mounted between the moving platform and the bottom wall of the jackhammer are two elastic ropes 22,24 and shock absorbers 26,28. The jackhammer is shown in a vertical orientation with the chisel lower-most at the foot of the jackhammer.

The moving platform 18 slides on the exterior surface of the ram cylinder 14. This necessitates the need for the external surface of the ram cylinder 14 to be machined to a close tolerance. It also introduces extra loads and wear on the ram cylinder. If the moving platform is not aligned correctly on the ram, its movement along the ram cylinder may create unwanted vibration. Additionally since the casing 2 is structural, with the other tool components being mounted off the casing 2, it comprises a casting of robust and heavy design. Hence the casing contributes significantly to the overall weight of the power tool. Although such devices may in practice be moved by a machine (for example coupled to an arm of a backhoe loader), they will inevitably need to be manhandled at some point.

Hence, a power tool which provides the advantages of the device of FIG. 1, delivers a higher impact force per unit weight of the power tool, and yet reduces wear and load on the ram cylinder, is highly desirable.

SUMMARY

According to the present disclosure there is provided an apparatus and method as set forth in the appended claims. Other features of the invention will be apparent from the dependent claims, and the description which follows.

Accordingly there may be provided a power tool having an operational axis, the power tool comprising: a tool carrier for mounting an impact tool, the tool carrier comprising: a base member aligned with the operational axis, the base member having: a head end for receiving impact energy; a foot end at an opposite end of the tool carrier, the foot end being provided with a tool mount configured to transmit the impact energy to a tool; and a casing engagement feature provided between the head end and foot end; and a first casing module, at least part of the tool carrier being located within the first casing module; the casing module being provided with a tool carrier engagement feature complementary in shape to and for interlocking engagement with the tool carrier casing engagement feature to thereby: prevent rotation of the tool carrier relative to the first casing module around the operational axis, and permit relative movement between the tool carrier and the first casing module along the operational axis.

There may also be provided a power tool having an operational axis, the power tool comprising: a tool carrier for mounting an impact tool, the tool carrier comprising: a base member aligned with the operational axis, the base member having: a head end for receiving impact energy; a foot end at an opposite end of the tool carrier, the foot end being provided with a tool mount configured to transmit the impact energy to a tool; and a casing engagement feature provided between the head end and foot end; and a first casing module, at least part of the tool carrier being located within the first casing module; the casing module being provided with a tool carrier engagement feature complementary in shape to and for interlocking engagement with the tool carrier casing engagement feature to thereby: prevent rotation of the tool carrier relative to the first casing module and around the operational axis, and permit relative movement between the tool carrier and the first casing module along the operational axis.

The tool carrier casing engagement feature may comprise a fin which: extends radially outwards from the tool carrier base member; and extends longitudinally along the length of the tool carrier base member such that, in use, the fin is aligned with the operational axis of the power tool.

The tool carrier casing engagement feature may further comprise a web plate which extends from an end of the fin around a circumference of the main member.

The first casing module engagement feature may be provided as a groove configured to receive the fin of the tool carrier casing engagement feature, the groove being aligned with the operational axis of the power tool; and configured to permit the tool carrier to move relative to the casing module along the operational axis.

The power tool may further comprise an actuator module centred on the operational axis; the actuator module having: a plurality of rods held in a fixed relationship to one another by: a mounting member towards one end of the rods, and a coupling member spaced apart from the mounting member towards an opposite end of the rods; the actuator module being coupled to the first casing module via the coupling member; and the coupling member is further provided with an aperture through which the head end of the tool carrier extends.

The power tool may further comprise a carrier mount for engagement with a carrier, the carrier mount being coupled to the end of the mounting member of the second casing module.

A second casing module may extend between the mounting member and the coupling member.

The actuator module may further comprise: a body, and an actuator for moving the body along the operational axis of the power tool: from an impact position at which the body is operable to transfer impact energy to the head of the tool carrier to a retracted position distal to the impact position and proximate to the mounting member.

The actuator may comprise a housing which extends from the carrier mount end of the power tool along the operational axis part way along the length of the second casing module within a volume defined between the plurality of rods.

The body may comprise: an actuator channel which extends from a head end of the body to a foot end of the body, the head end of the body facing the carrier mount end of the power tool, the foot end of the body facing the head end of the tool carrier, such that when the body travels between the retracted position and the impact position, a clearance is maintained between the actuator housing and the body.

The actuator channel may terminate in a hammer plate configured to strike the head end of the tool carrier.

The actuator may be a hydraulic or pneumatic ram comprising a piston.

The ram piston may be provided with a clutch mechanism for selectively engaging with the body, and arranged such that: at the impact position the clutch mechanism is operable to couple the body to the piston; the clutch is operable to couple the body to the piston while the body is carried by the piston to the retracted position; and at the retracted position the clutch mechanism is operable to uncouple the body from the piston, permitting the body to move on an impact stroke to the impact position substantially without hindrance from the piston.

The body may define passages in slideable engagement with at least some of the rods; configured such that the body may translate between the impact position and the retracted position along at least some of the rods.

The body may have a greater mass than mass of the tool carrier, or may have a greater mass than the combined mass of the tool carrier and tool assembly.

The power tool may further comprise of an array of elastic ropes, one end of the array of elastic ropes being coupled to the body, and another end of the elastic ropes being coupled to the coupling member; configured such that the body may translate from the impact position to the retracted position in a first direction along at least some of the rods under the action of the actuator and against the force developed by the elastic ropes; and wherein the body is biased to move in a second direction along at least some of the rods towards its impact position from its retracted position by the elastic ropes whilst uncoupled from the actuator.

The ropes may be coupled via a direct load transmission path to the coupling member and body.

At least one of the ropes may comprise a solid rubber core member.

The at least one rope may be provided with a body end cap at one end for engagement with the body; and a coupling member end cap at its other end for engagement with the coupling member, a largest external diameter of the body end cap being greater than the largest external diameter of the coupling member end cap.

The end caps may be joined to the rope by an adhesive.

The body may comprise a rope passage which extends from a head end of the body to a foot end of the body, at least one of the ropes extending through the rope passage.

The head end of the rope passage may comprise a restriction having an internal diameter less than the maximum external diameter of the body end cap, and greater than the maximum external diameter of the coupling member end cap such that, during assembly, the coupling end cap and rope can be entered in the head end of the rope passage, passed along the rope passage and extend out of the foot end of the rope passage so that the body end cap is caught in the head end of the rope passage; and the coupling member end of the rope may be attached to the coupling member.

The body end cap may be tapered along its length.

The second casing module may comprise an access panel located to enable access to the head end of the body to facilitate the insertion and removal of a rope from the rope passage.

The coupling end cap of the rope may comprise: a locking shoulder or slot; the coupling member comprises rope apertures through which the coupling member end cap extends; the coupling member comprises slots which extend from the rope apertures to a radially outer surface of the coupling member; and each slot is provided with a locking fork which is slideable within the slot such that when the coupling end cap extends through the rope aperture in the coupling member, the locking fork may be slid to engage with the locking shoulder or slot to thereby lock the end cap to the coupling member; and the locking fork may be slid to disengage with the locking shoulder or slot to thereby release the end cap from the coupling member.

The coupling member slot may have a first region having a first width radially inward of a second region having a second width narrower than the first width; and the fork has a main body region and a neck region, the second region of the slot being narrower than the main body region of the fork, such that the fork is retained and slideable within the slot.

A first damper may be provided between the coupling member and the tool carrier.

The first damper may comprise at least two damping members in series along the operational axis.

The at least two damping members may have different stiffness to one another.

A second damper may be provided between the tool carrier and a foot end of the first casing module.

The second damper may comprise at least one fluid damper.

There may also be provided a method of applying a percussive force to an object, using a power tool as claimed in any preceding claims.

Thus there is provided a power tool having many advantages over related art devices.

For example, it provides a tool carrier that will not twist with respect to the rest of the power tool, hence ensuring any attached cutting tool remains correctly aligned. The power tool of the present disclosure also produces less noise and less vibration, which is of importance to a tool operator and anyone else in the vicinity of where the tool is being operated. It also manages forces arising during a "mis-fire" of the tool better than a device of the related art. Hence a device according to the present disclosure is an improvement in many ways over devices of the related art.

BRIEF DESCRIPTION OF THE DRAWINGS

Examples of the present disclosure will now be described with reference to the accompanying drawings, in which.

DETAILED DESCRIPTION

Figure 2:
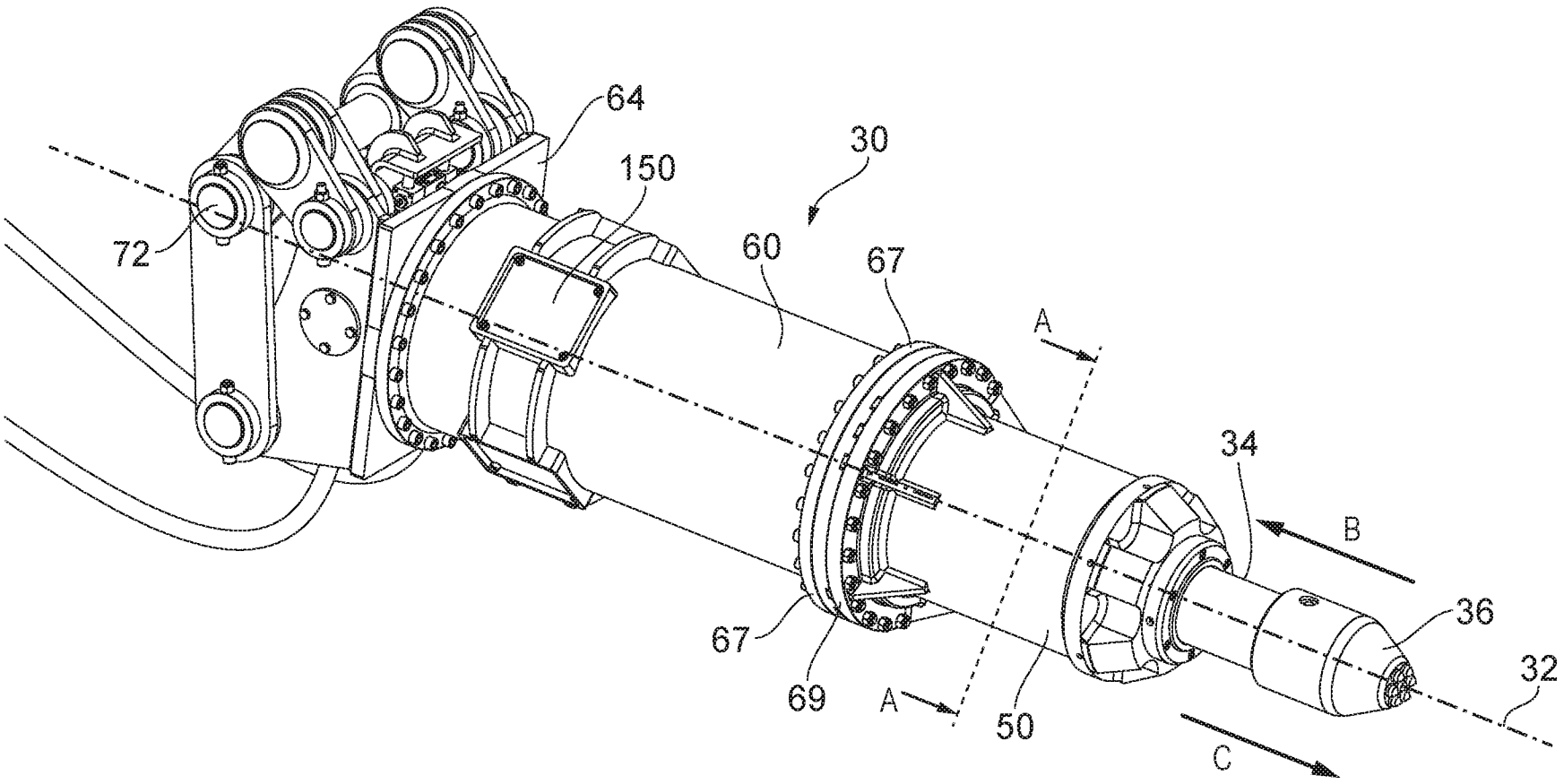
FIG. 2 shows a perspective view of a power tool according to the present disclosure.
Figure 3:
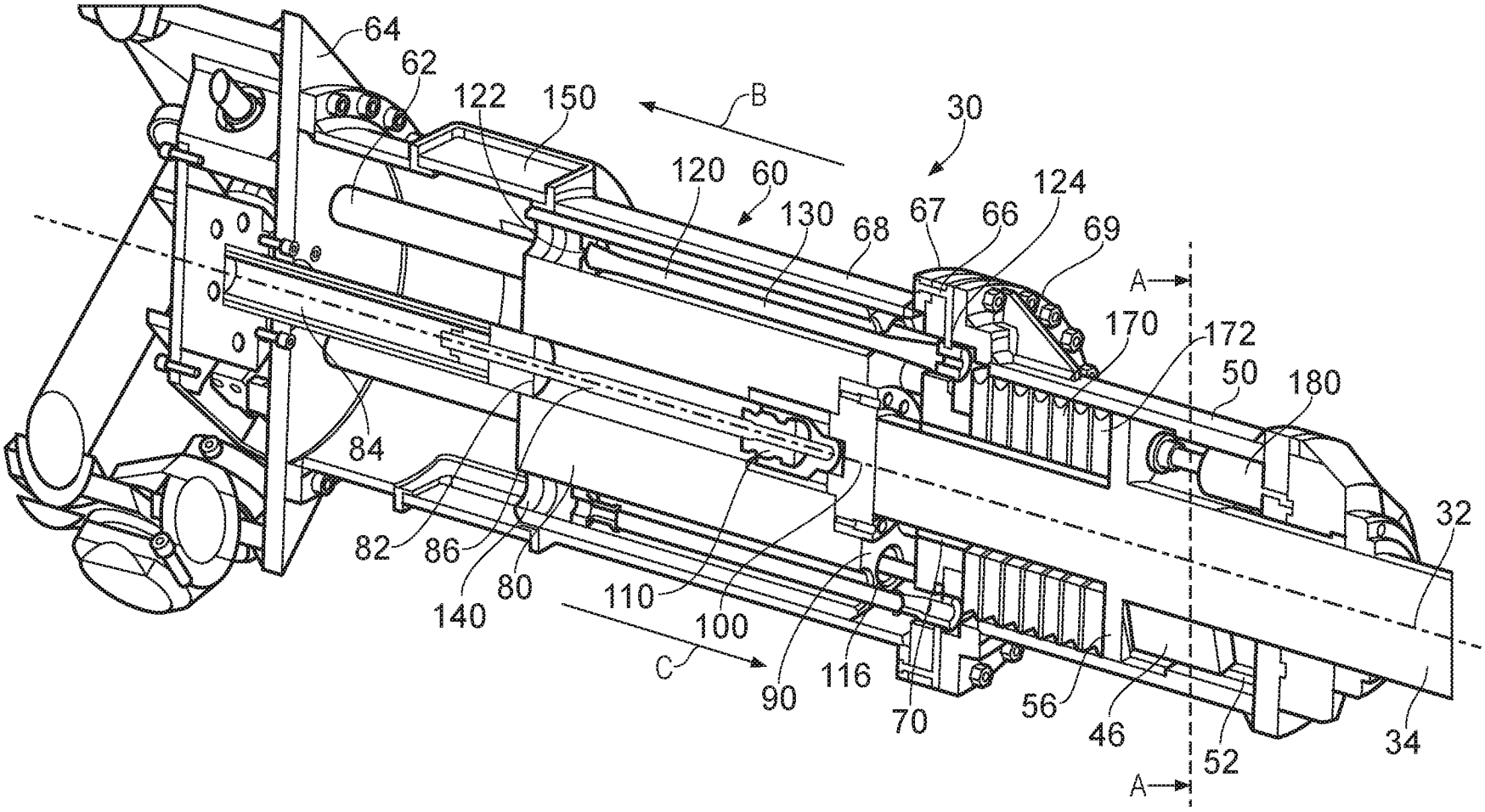
FIG. 3 shows a cross sectional view of the power tool of FIG. 2.
Figure 4:
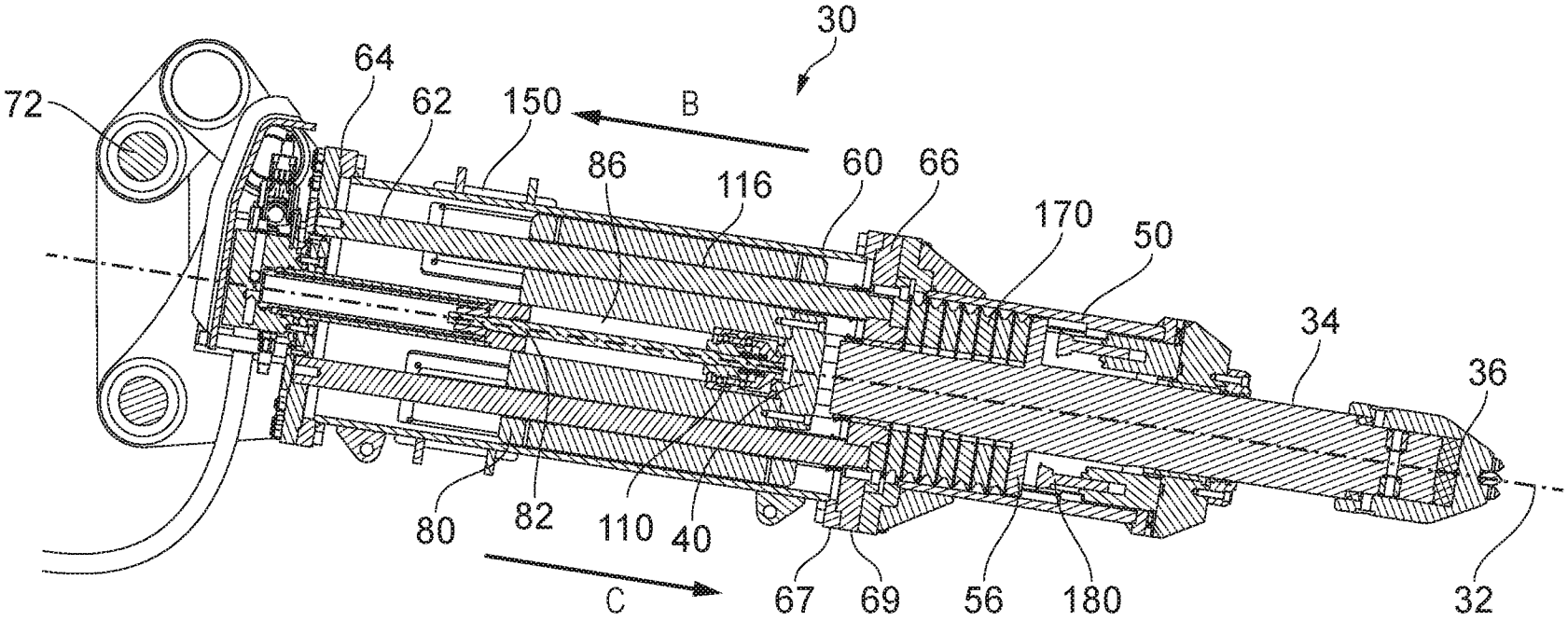
FIG. 4 shows a further cross sectional view of the power tool of FIG. 2 in an impact configuration.
Figure 5:
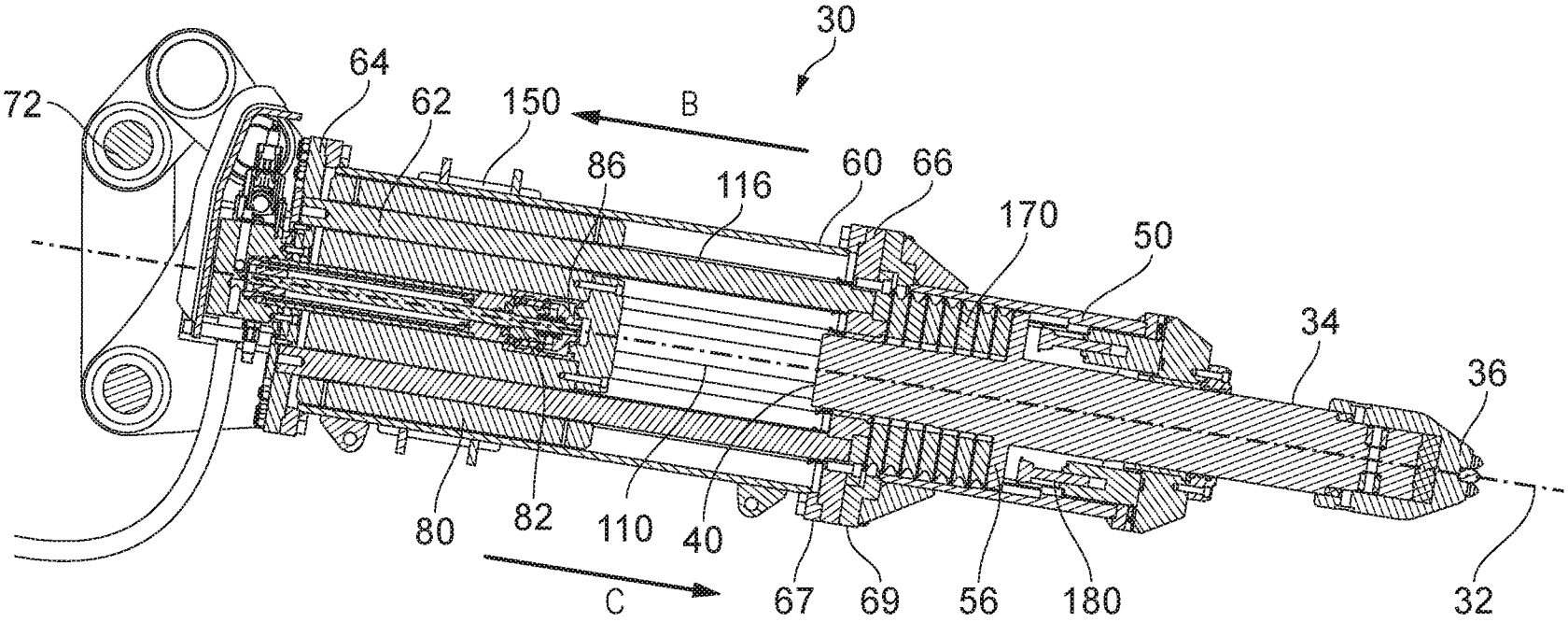
FIG. 5 shows a cross sectional view of the power tool of FIG. 4 in a retracted configuration.

FIG. 2 shows a perspective view of a power tool 30 according to the present disclosure. FIGS. 3 to 5 show cross sectional views of the power tool 30 as shown in FIG. 2. The power tool 30 comprises a structure which defines an operational axis 32 from a nominal "head" end of the power tool to a nominal "foot" end, which may be towards the "top" end and "bottom" end respectfully of the power tool 30 in normal use.

The power tool 30 comprises a tool carrier 34 for mounting (that is to say, supporting or carrying) an impact tool 36. One example of an impact tool 36 is shown mounted on the end of the tool carrier 34 is shown in FIG. 2. The tool 36 is one of many different kinds of tools that may be attached to the tool carrier 34, some of which are illustrated in FIGS. 4, 5, 7, 8 and 9.

Figure 6:
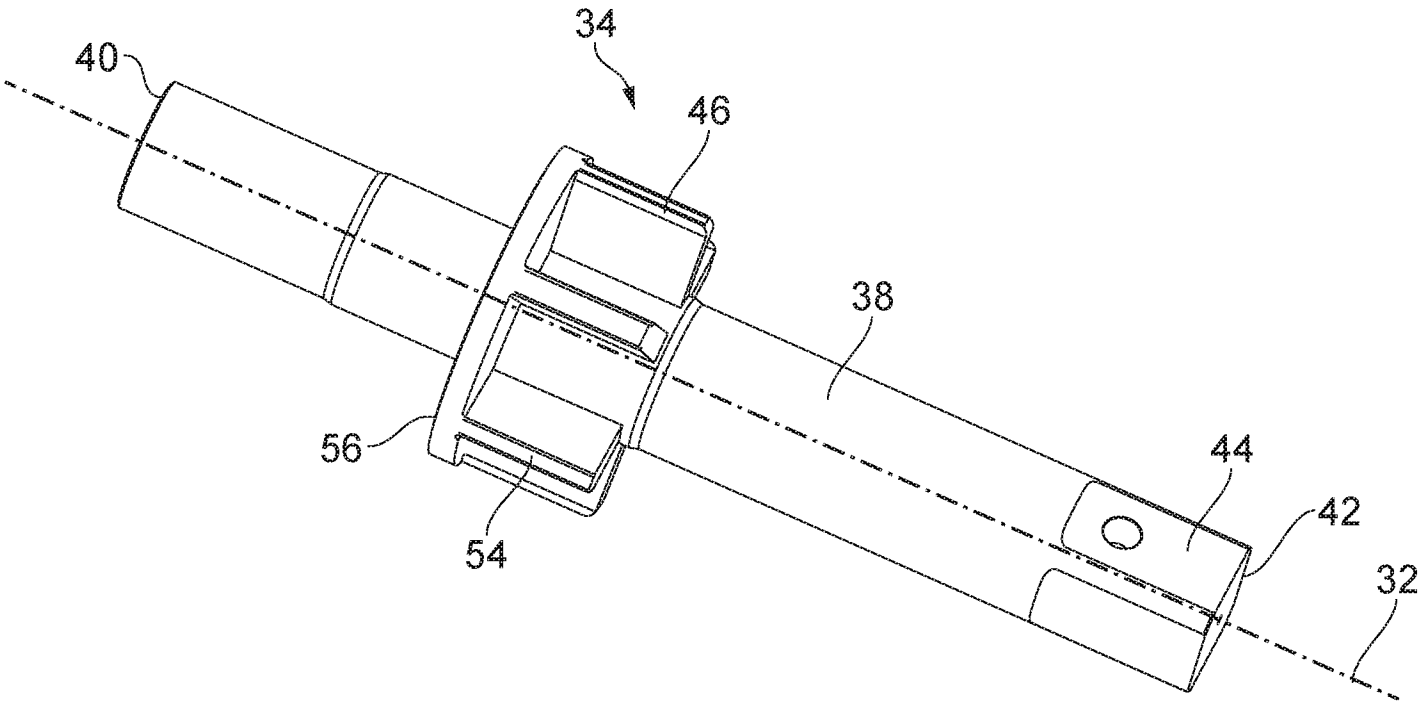
FIG. 6 shows a perspective view of a tool carrier of the power tool shown in FIGS. 2 to 5.

The tool carrier 34 is shown in more detail in FIG. 6. The tool carrier 34 comprises a base member 38, which in use is aligned with the operational axis 32. The base member 38 has a head end 40 for receiving impact energy (or "impact load"). The base member 38 also has a foot end 42 at an opposite end of the tool carrier 34 to the head end 40, the foot end 42 being provided with a tool mount 44 configured to transmit the impact energy to the foot end 42 and hence the impact tool 36. The tool carrier 34 further comprises a casing engagement feature 46 provided between the head end 40 and the foot end 42.

The power tool 30 further comprises a first casing module 50, where, as shown in FIGS. 2 to 5, 9, 10 and 13, at least part of the tool carrier 34 is located within the first casing module 50. The casing module 50 is provided with a tool carrier engagement feature 52 which is complementary in shape to, and is for interlocking the engagement with, the casing engagement feature 46.

Figure 7:
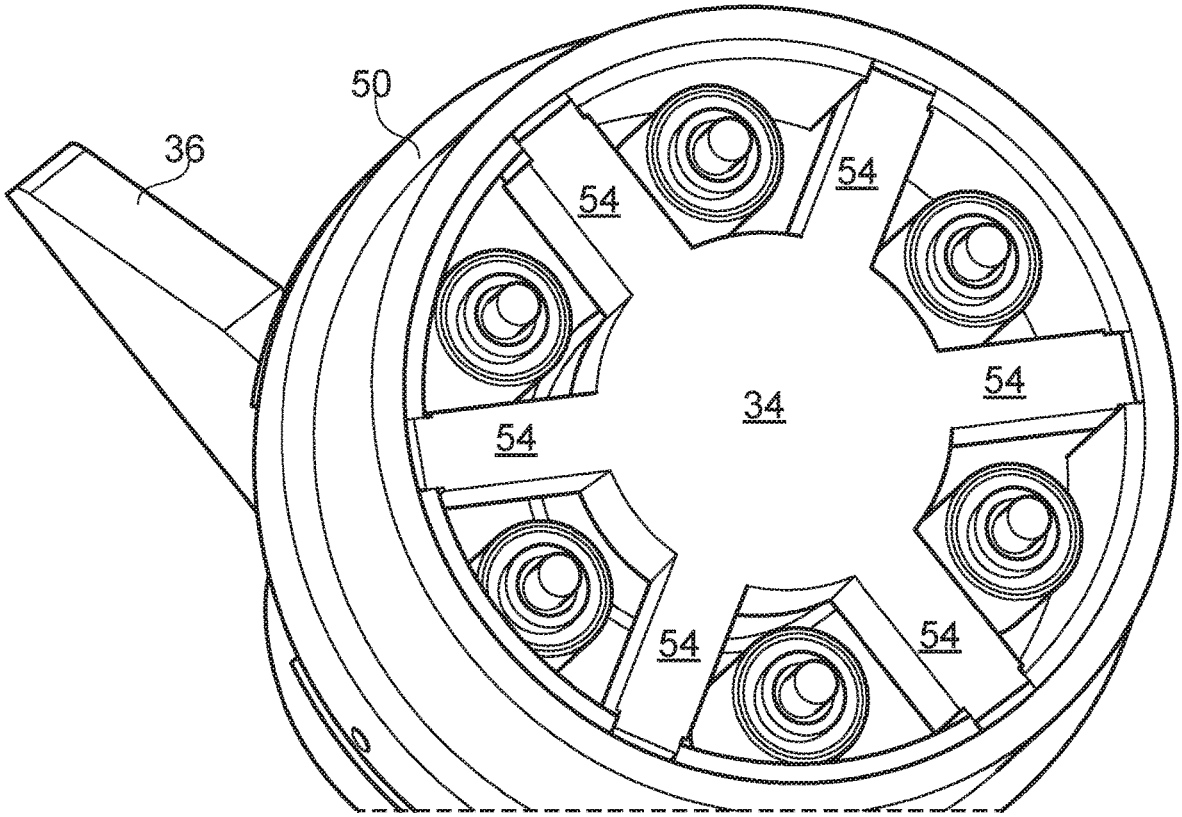
FIG. 7 shows a cross sectional view of the power tool along line A-A as indicated in FIGS. 2, 3.

As best shown in FIGS. 6, 7, the tool carrier casing engagement feature 46 comprises a fin (or rib) 54 which extends radially outwards from the tool carrier base member 38, and extends longitudinally along the length of the tool carrier base member 38 such that, in use, the fin 54 is aligned with the operational axis 32 of the power tool 30. In the example shown, several fins/ribs 54 are provided. The tool carrier casing engagement feature 46 further comprises a web plate 56 which extends from an end of the or each fin 54 around the circumference of the main member 38. The web plate 56 is provided towards the head end 40 of the tool carrier 34, providing a platform which extends between the fins/ribs 54.

The casing module engagement feature 52 comprises a groove 52 configured to receive the fin 54 of the tool carrier casing engagement feature 46. In the example shown, several grooves 52 are provided, spaced around the inner surface of the first casing module 50 such that each groove 52 receives one of the fins 54 of the tool carrier casing engagement feature 46. Each groove 52 is aligned with (that is to say, parallel and orientated in the same direction as) the operational axis 32 of the power tool 30. That is to say, the grooves 52 are parallel to, and offset from, the operational axis 32.

Thus the fins 54 are located in the grooves 52 so as to prevent rotation of the tool carrier 34 relative to the first casing module 50 around the operational axis 32. That is to say, the fins 54 are located in the grooves 52 so as to prevent rotation of the tool carrier 34 relative to the first casing module 50, and to prevent rotation of the tool carrier 34 around the operational axis 32. However, the fins 54 are also slideable within the grooves 52 to enable relative movement between the tool carrier 34 and the first casing module 50 along the operational axis 32. That is to say, the groove 52 seats and locates the fin 54, so that the tool carrier 34 cannot move relative to the first casing module 50 around the operational axis 32. Put another way, the groove 52 seats and locates the fin 54 so that the tool carrier 34 cannot rotate around the operational axis 32 relative to the first casing module 50, and so that the tool carrier 34 cannot rotate around the operational axis 32. That is to say, since the groove 52 seats and locates the fin 54 so that the tool carrier 34 cannot rotate relative to the first casing module 50, and since the first casing module is non-rotatable around the operational axis, the engagement of the groove 52 and fin 54 ensures that the tool carrier 34 is non-rotatable around the operational axis 32. However, because each fin 54 is slidably located in its respective groove 52, the tool carrier 34 is operable to move in a direction along (or parallel) to the operational axis 32 by virtue of the fact that the fins 54 are carried within their respective grooves 52.

The power tool 30 further comprises an actuator module 60 centred on the operational axis 32. The actuator module 60 has a plurality of rods 62, spaced apart from, and parallel with, one another and the operational axis 32 to form a "squirrel cage". In the example shown four rods 62 are provided. However, the power tool 30 may comprise more than four rods 62. The rods 62 are held in a fixed relationship with respect to one another by a mounting member 64 towards, or at, one end of the rods 62, and a coupling member 66 spaced apart from the mounting member 64 towards an opposite end of the rods 62. The actuator module 60 further comprises a second casing module 68 which extends around the rods 62, and also extends between the mounting member 64 and the coupling member 66. The second casing module 68 is coupled to the first casing module 50 via the coupling member 66. That is to say second casing module 68 is coupled (for example bolted) to the first casing module 50, with the coupling member 66 interspaced, and hence clamped, between the ends of the first casing module 50 and the second casing module 68.

Alternatively or additionally, the casing module 68 may be formed integrally with, or separately from, one or more of the mounting member 64 and coupling member 66.

As shown in the FIGS. 2 to 5, 8, 9, 10 and 13, the first casing module 50 and second casing module 68 are provided with flanges 67, 69 at their ends which are coupled together. Bolts extend through the flanges 67, 69 of the first casing module 50 and the second casing module 68, the coupling member 66 being provided between the flanges 67, 69 of the first casing module 50 and second casing module 68 to thereby clamp the coupling member 66 between the flanges. The coupling member 66 is further provided with an aperture 70 through which the head end 40 of the tool carrier 34 extends.

The power tool 30 may further comprise a carrier mount 72 for engagement with a carrier (not shown). The carrier may take the form of a vehicle, for example a backhoe loader. As shown in FIGS. 2 to 5, 9 and 14, the carrier mount 72 is coupled to the end of the mounting member 64 of the second casing module 68.

The actuator module 60 further comprises a body 80 and an actuator 82 for moving the body 80 along the operational axis 32 of the power tool 30. The actuator 82 is operable to move the body 80 in a first direction (indicated by arrow "B" in FIGS. 2 to 5) along the operational axis 32 from an impact position, in which the body 80 transfers impact energy (or "impact load") to the head 40 of the tool carrier 34 (for example, as shown in FIG. 4), to a retracted position distal to the impact position towards the mounting member 64 (for example, as shown in FIG. 5). The actuator 82 may be a hydraulic or pneumatic ram comprising a piston, as shown in the figures. The actuator 82 may be powered by the carrier vehicle, for example supplied by hydraulic fluid pumped from the carrier vehicle. The actuator 82 comprises a cylinder housing 84 which extends from the carrier mount 64 end of the power tool 30 along the operational axis 32 part way along the length of the second casing module 68 within a volume enclosed by the "squirrel cage" defined by the plurality of rods 62.

The body 80 comprises an actuator channel 86 which extends from a head end 88 of the body 80 to a foot end 90 of the body 80. The head end 88 of the body 80 faces the carrier mount 64 end of the power tool 30. The foot end 90 of the body 80 faces the head end 40 of the tool carrier 34. The actuator channel 86 is sized relative to the size of the cylinder housing 84 of the actuator, such that there is a clearance between the actuator housing 84 and the body 80. Hence when the body 80 travels between the retracted position and the impact position, a clearance is maintained between the actuator housing 84 and the body 80.

The actuator channel 80 terminates in a hammer plate 100 configured to strike the head end 40 of the tool carrier 34.

The ram piston is provided with a clutch mechanism 110 for selectively engaging with the body 80, and arranged such that during a return stroke to the retracted position (as shown in FIG. 5) the clutch mechanism 110 acts to couple the body 80 to the piston, so that the piston carries with it the body 80, and at the retracted position the clutch mechanism 110 acts to uncouple the body 80 from the piston 82, permitting it to move in a second direction (indicated by arrow "C" in FIGS. 2 to 5) on its impact stroke substantially without hindrance from the piston 82. At the impact position (shown in FIG. 4) the clutch mechanism acts once more to couple the body 80 to the piston 82. The ram piston 82 is wholly responsible for moving the body 80 from its impact position (shown in FIG. 4) to its retracted position (shown in FIG. 5) along the rods 62 in the first direction "B".

The body 80 defines passages 116 in slideable engagement with at least some of the rods 62. The passages 116 are configured such that the body 80 may translate between the impact position and the retracted position at least along some of the rods 62. In the example shown, the body 80 is carried on, and slides along, all of the rods 62.

The body 80 has a greater mass than the mass of the tool carrier 34. The body also has a greater mass than the mass of the tool carrier 34 and tool assembly 36. That is to say, the body has a greater mass than the combined mass of the tool carrier 34 and tool assembly 36.

Figure 8:
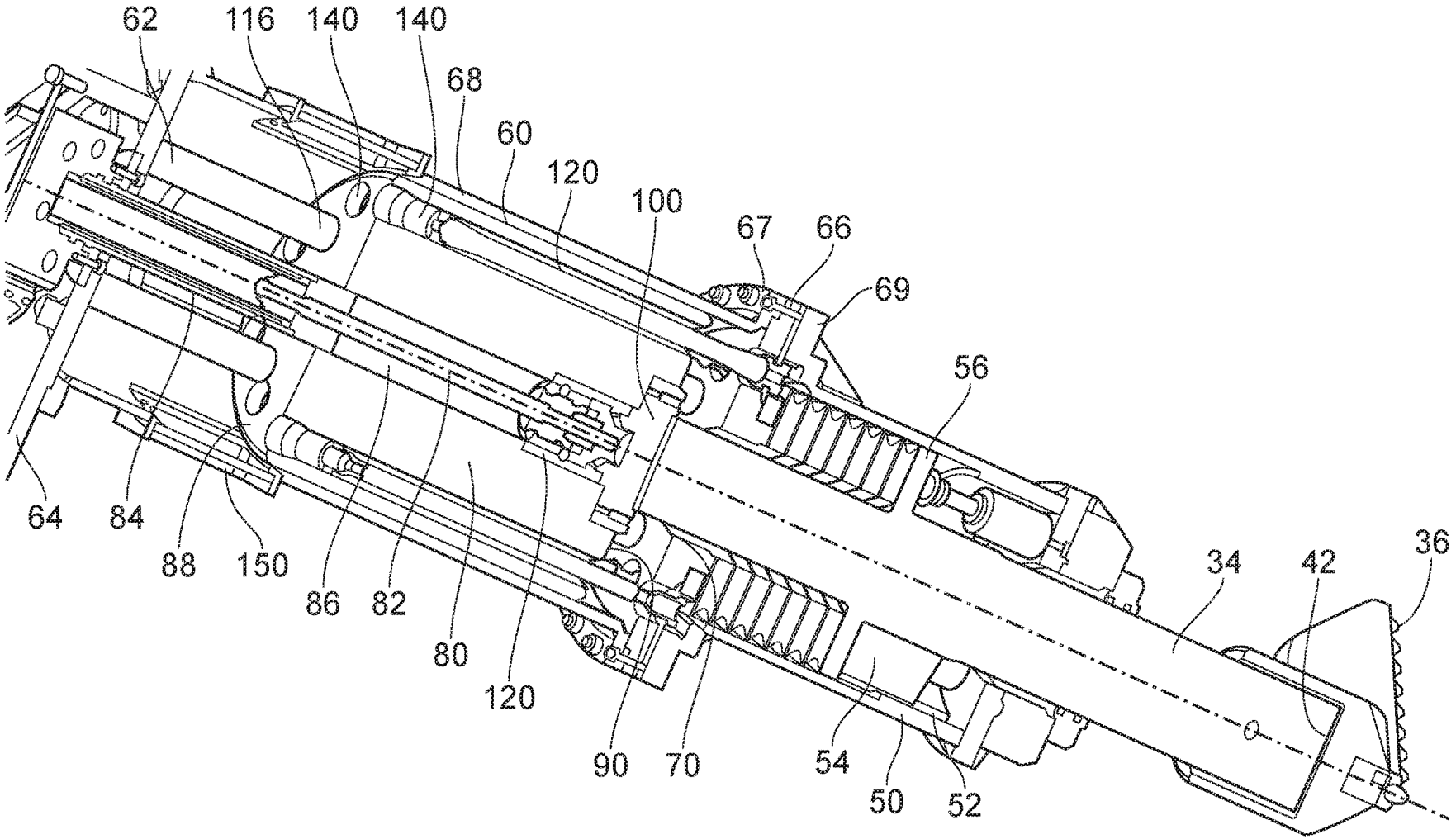
FIG. 8 shows a similar view to that in FIG. 3, with the section orientated differently to illustrate different details.
Figure 9:
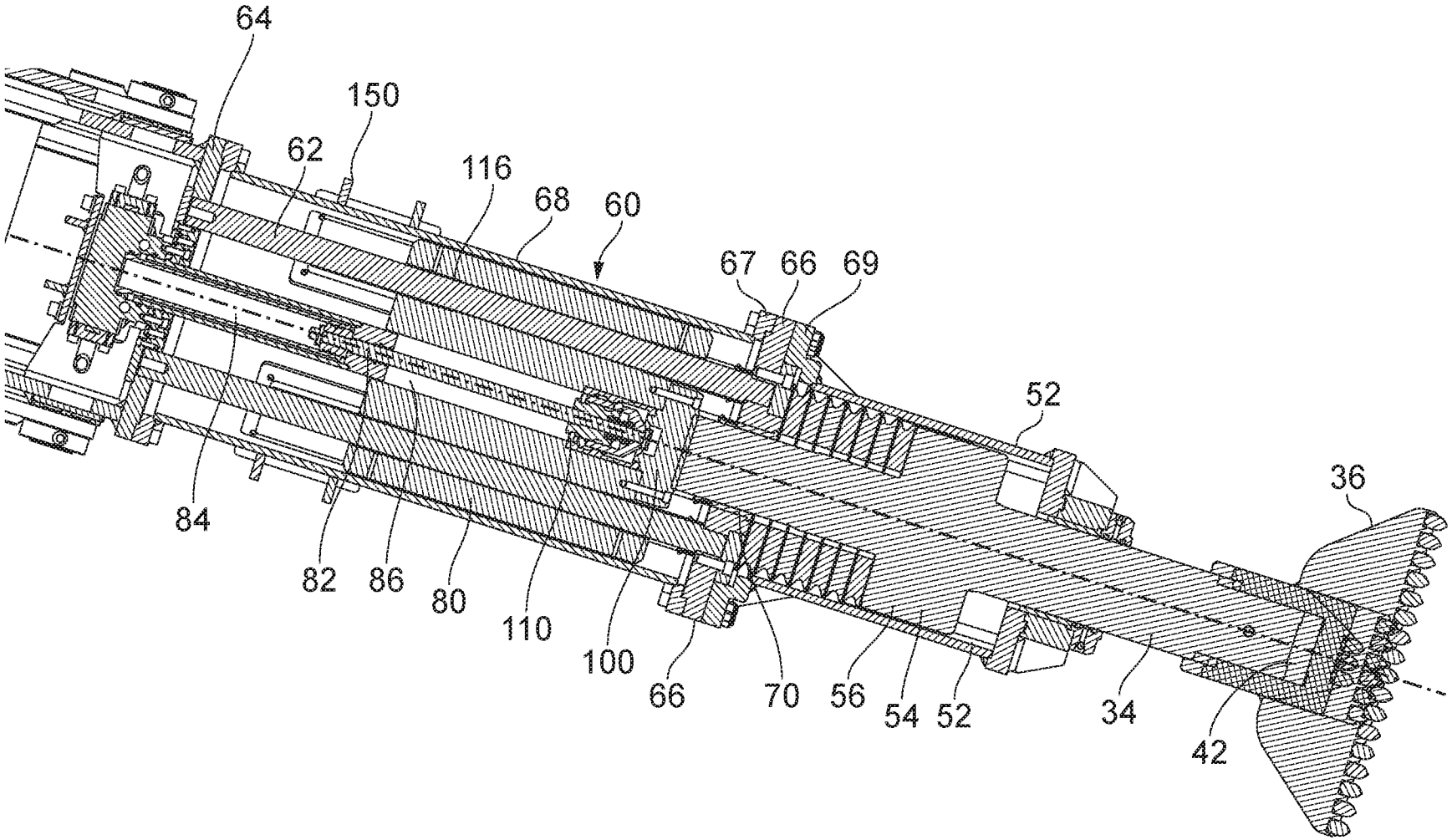
FIG. 9 shows a sectional view through a different region to that shown in FIG. 8.

As shown in FIGS. 3, 8, 10, 11, and 13 the power tool further comprises an array of elastic ropes 120. As shown in FIGS. 3, 8, one end 122 of the array of elastic ropes 120 is coupled to the body 80 and another end 124 of the elastic ropes 120 is coupled to the coupling member 66. The ropes 120 are coupled via a direct load transmission path to the coupling member 66 and body 80. That is to say that although the ropes 54 may not be literally directly attached to the body 80 and/or coupling member 66, forces are communicated between the ropes 120 and the body 80 and between the ropes 120 and coupling member 66 along a direct (that is to say uninterrupted) force transmission path. Put another way, apart from minor losses, the load communicated between the ropes 120 and the body 80 and between the ropes 120 and coupling member 66 is not damped in any way.

Figure 10:
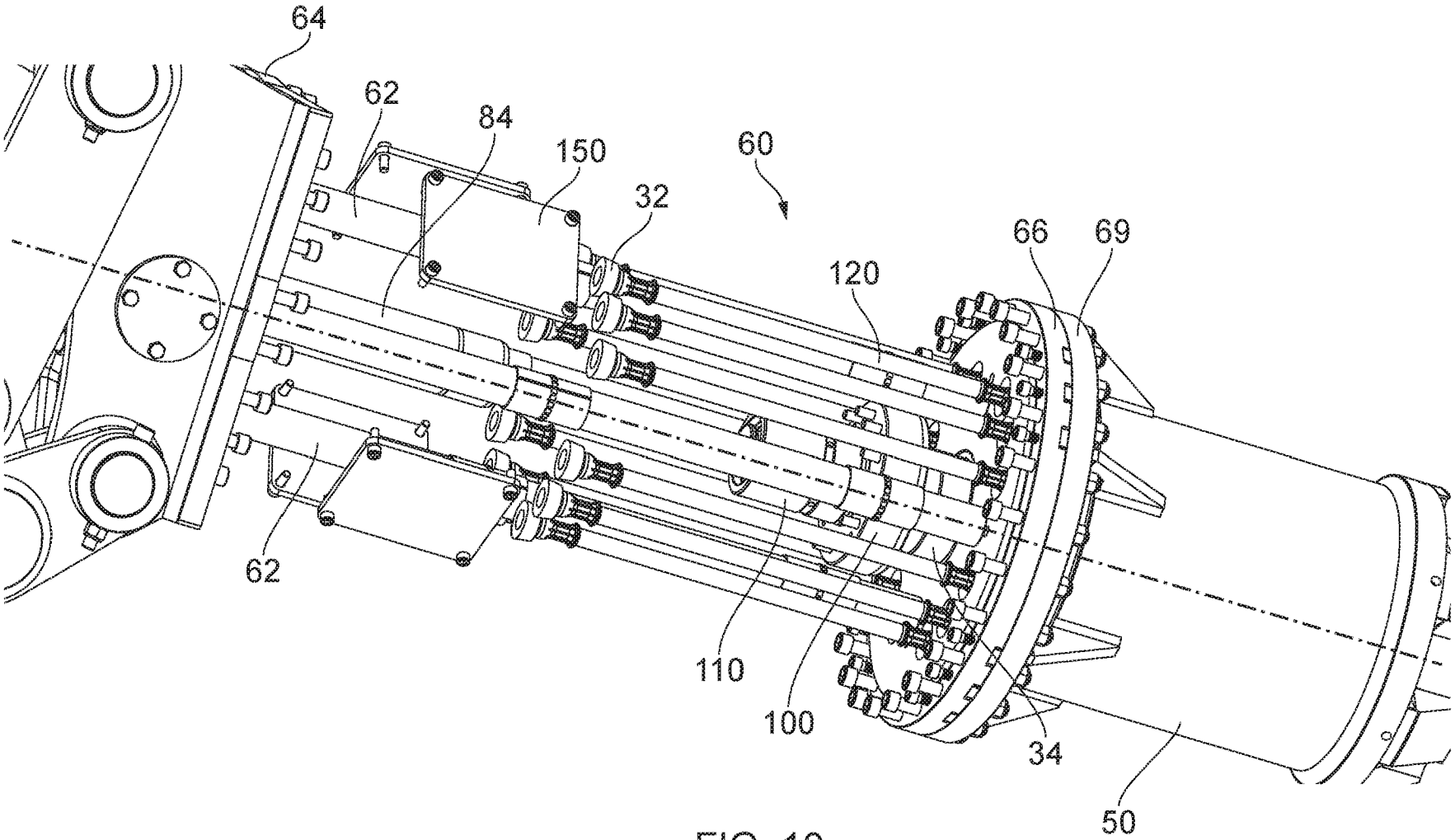
FIG. 10 shows features of an actuator module of the present disclosure, with some features of the device removed for clarity.
Figure 11:
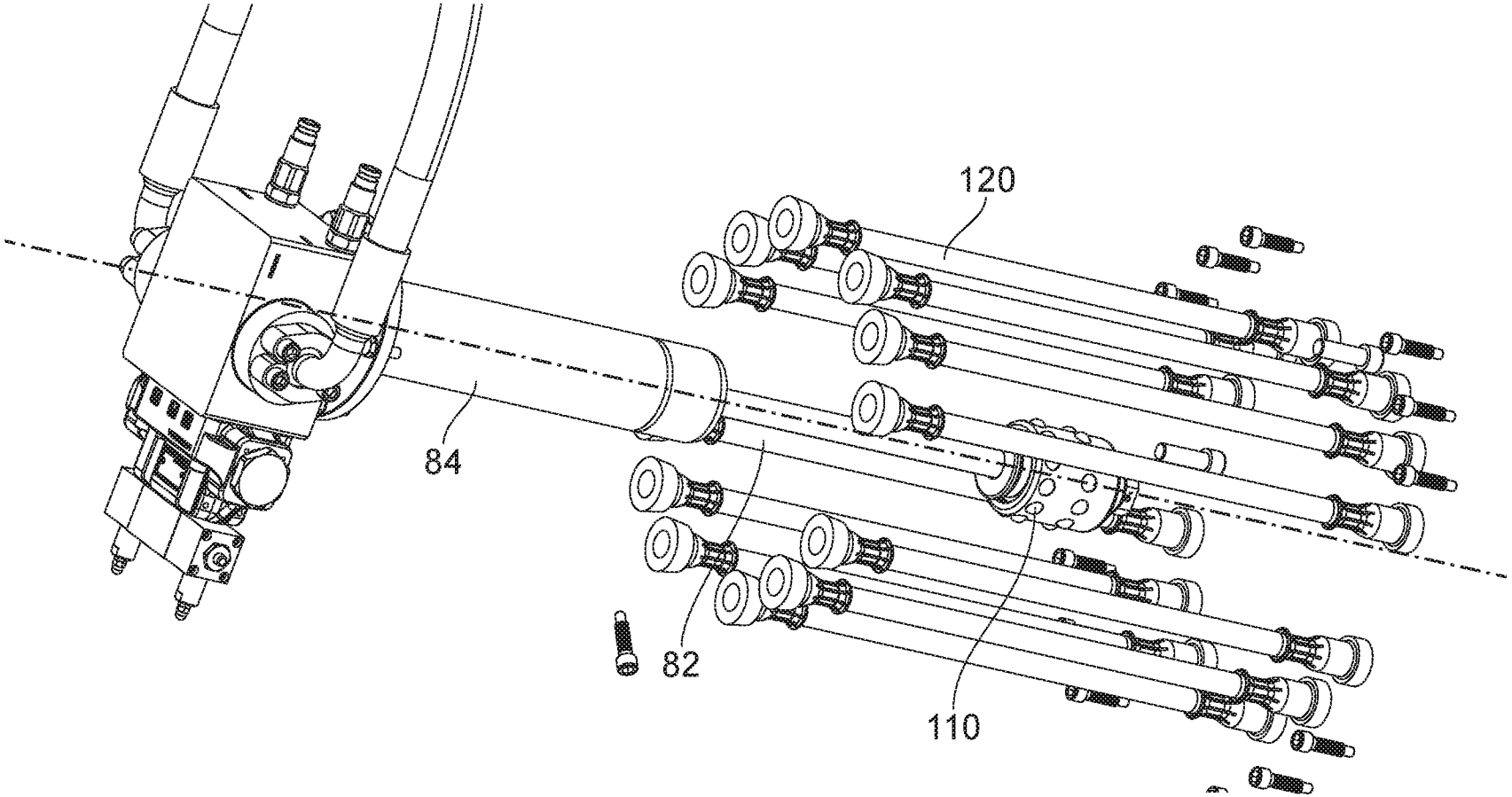
FIG. 11 shows some of the features of the actuator module shown in FIG. 10 with further details removed for clarity.
Figure 12:
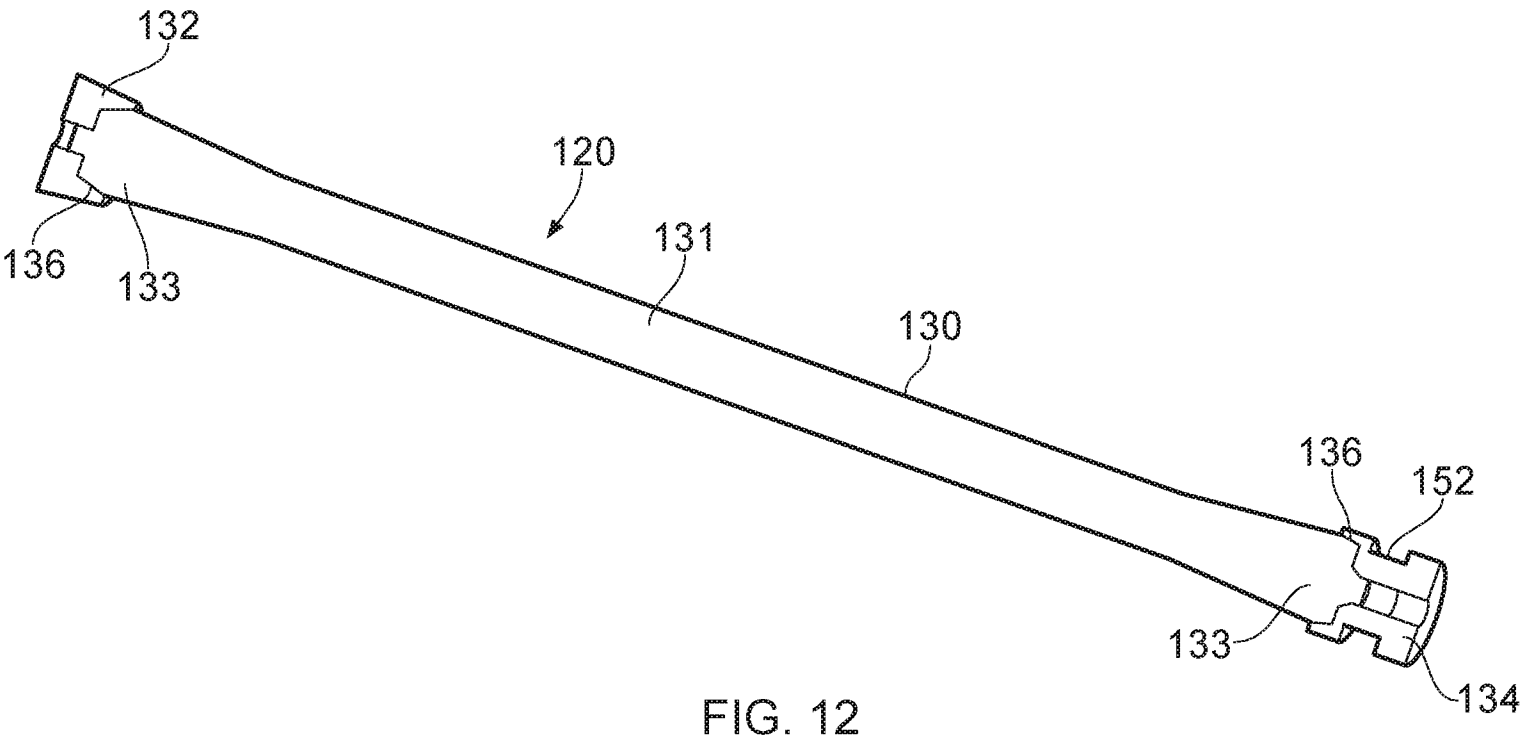
FIG. 12 shows a rope assembly of the power tool of the present disclosure.

The ropes 120 are shown in more detail in FIGS. 10, 11 and 12. FIG. 10 omits the detail of the body 80 and second casing module 68. FIG. 11 shows only the actuator 82 and ropes 120. FIG. 12 shows a cross section of one of the ropes 120.

At least one of the ropes comprises a solid rubber core member 130. The solid core member 130 may comprise a middle section 131 of substantially uniform thickness. That is to say, it may have substantially uniform diameter in a non-extended state and when extended. The solid core member may also be provided with ends 133 which have a greater thickness (i.e. diameter) then the middle section 131. The ends 133 may be frusto-conical. That is to say, the solid core member 131 may increase in diameter/thickness along at least part of the length of the core member 131 towards the ends 133.

The rope may be made from neoprene or natural rubber. This composition may provide a rope which can stretch at least 1.6 times (i.e. 160%) its non-extended (i.e. at rest) length, with an upper elastic limit of three times (i.e. 300%) its non-extended (i.e. at rest) length.

Each rope 130 may be provided with a body end cap 132 at one end for engagement with the body 80, and a coupling member end cap 134 at its other end for engagement with the coupling member 66. The largest external diameter of the body end cap 132 is greater than the largest external diameter of the coupling member end cap 134.

The end caps 132, 134 are pushed over the ends 133 of the core member 130, such that ends 133 are received in a chamber (or "cavity") formed within the end caps 132,134. The geometry of the end cap cavity is complementary in shape to the geometry of the rope ends 133 to trap the end caps 132, 134 onto the rope core member 130. An important feature is that the end caps 132, 134 are not crimped around the rope ends 133, as this would generate a stress raising feature which may shorten the operational life of the rope assembly 120.

An adhesive 136 may also be provided between the solid rubber core member 130 and the material of the end caps 132, 134.

The solid core member 130 may be provided as the only elastic and extendable part of the rope. That is to say, no sheath or braiding may be provided around the solid core member 130. The reason for this is best understood with reference to conventional elastic ropes, which comprise a braided sheath. The sheath is essential to such rope types to protect the elastic fibres from abrasion (e.g. when being uncoiled, or pulled over surfaces). The sheath moves with the elastic fibres as the rope extends and contracts. Once the sheath is fully extended, the rope cannot extend any further.

By contrast, the ropes of the present disclosure comprise solid rubber core members 130, which inherently do not need retaining by a sheath. Neither to they require a sheath to prevent abrasion as they are positioned and mounted such that abrasion is unlikely. Also the absence of a sheath means the ropes may stretch further relative to their non-extended state, and hence store more energy, than a braided rope could achieve.

The ropes 120 are not pre-loaded. That is to say, in a non-extended state, no energy is stored in the ropes 120.

As shown in FIG. 12, the body end cap 132 is tapered along its length. Its diameter reduces in value from its end in a direction towards the coupling member end cap 134 at the opposite end of the rope 120. The coupling end cap 134 of the rope 120 comprises a locking shoulder or slot 152.

The body 80 comprises a rope passage 140 which extends from the head 88 of the body 80 to a foot end 90 of the body 80, where the head end 88 of the body 80 faces the mounting member 64 end of the power tool 30, and the foot end of the body 80 faces the head end 40 of the tool carrier 34. At least one of the ropes 120 extends through at least one of the rope passages 140.

The head end of the rope passage 140 comprises a shoulder or restriction having an internal diameter less than the maximum external diameter of the body end cap 132. The shoulder/restriction also has an internal diameter greater than the maximum external diameter of the coupling member end cap 134. Hence, during assembly, the coupling end cap 134 and core member 130 can be entered into the head end of the rope passage 140, passed along the rope passage 140, and extend out of the foot end of the rope passage 140 so that the body end cap 132 is caught in by the restriction at the head end of the rope passage 140, and the coupling member end cap 134 of the core member 130 may be attached to the coupling member 66.

The second casing module 68 comprises an access panel 150 located to enable access to the head end 88 of the body 80 to facilitate the insertion and removal of a rope 120 from the rope passage 140.

The coupling member 66 comprises rope apertures 154 (not shown) through which the coupling member end cap 134 extends. The coupling member 66 comprises slots 156 which extend from the rope apertures 154 to a radially outer surface of the coupling member 66. Each slot is provided with a locking fork 158 which is slideable within the slot 156 such that when the coupling end cap 134 extends through the rope aperture 154 in the coupling member 66, the locking fork 158 may be slid to engage with the locking shoulder 152 or slot 152 to thereby lock the end cap 134 to the coupling member 66. The locking fork 158 may be slid to disengage with the locking shoulder 152 or slot 152 to thereby release the end cap 134 from the coupling member 66.

Figure 13:
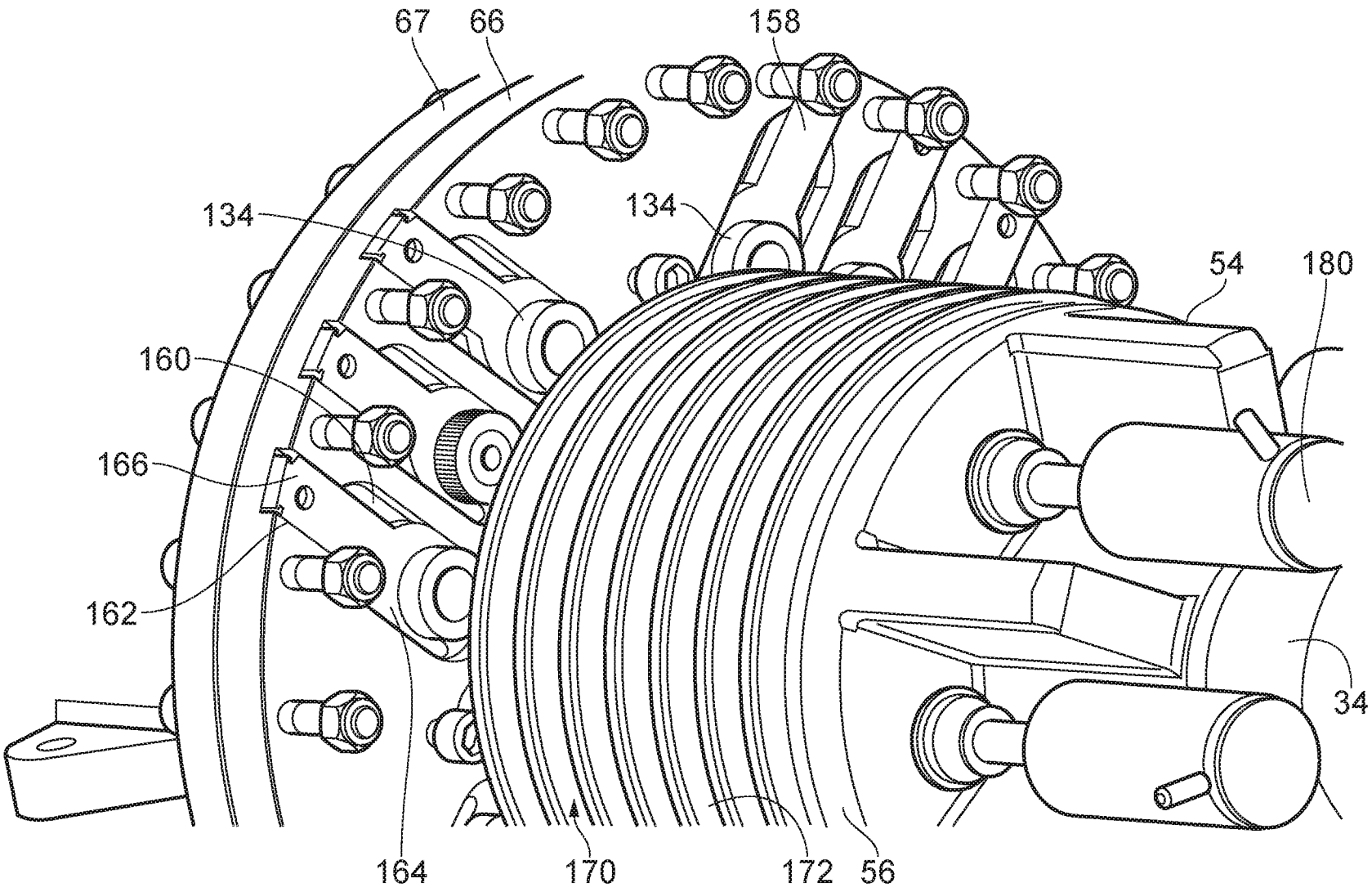
FIG. 13 shows an enlarged view of the damping system of the power tool of the present disclosure, with features removed for clarity.
Figure 14:
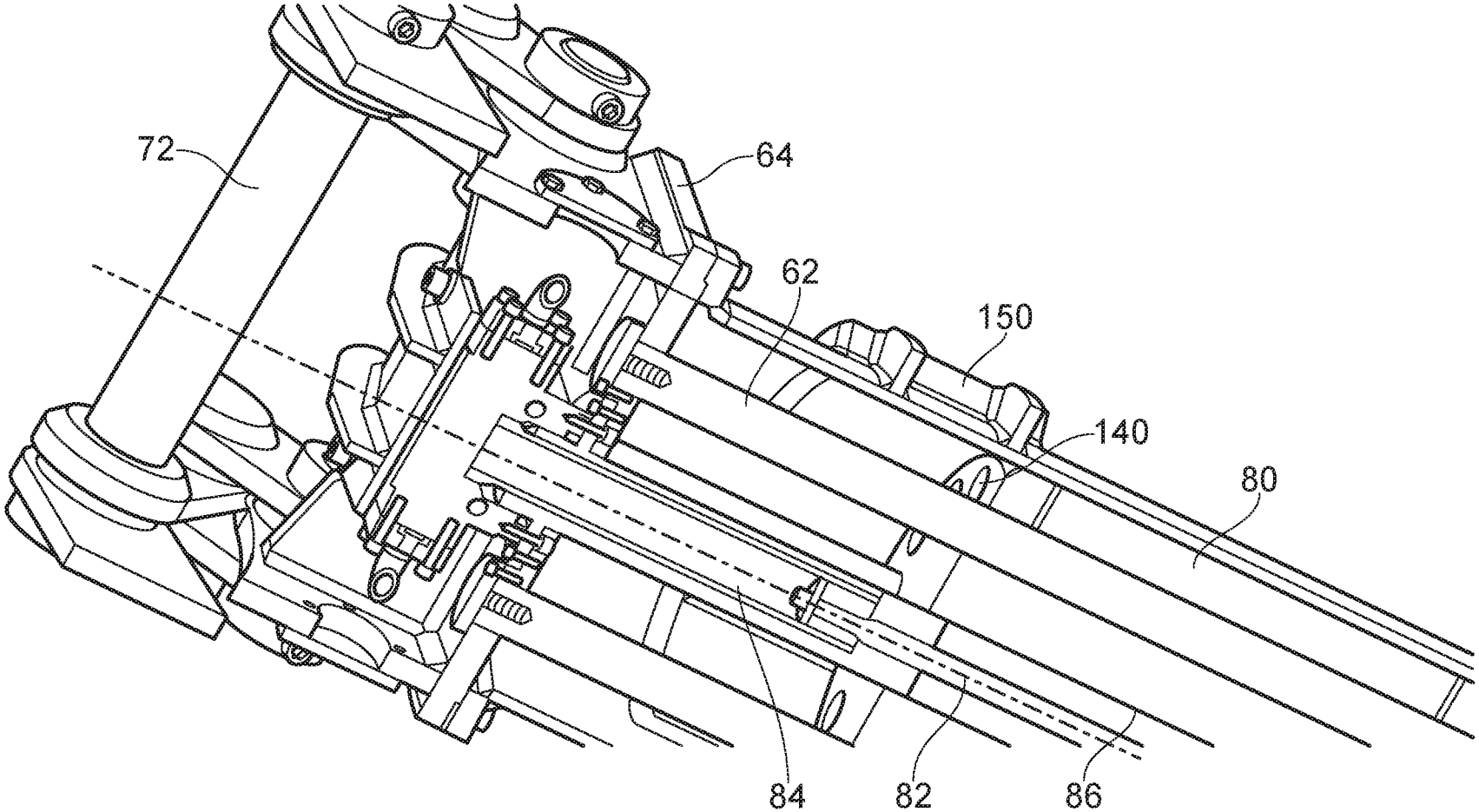
FIG. 14 shows an enlarged view of the illustration of FIG. 9 of the actuator and mounting members of the power tool of the present disclosure.

As shown in FIG. 13, the coupling member slots 150 have a first region 160 having a first width radially inwards of a second region 162 having a second width, the second width being narrower than the first width. FIG. 13 omits the detail of the first casing module 50 for clarity. The fork 158 has a main body region 164 and a neck region 166, the second region 162 of the slot 156 being narrower than the main body region 164 of the fork 158, such that the fork 158 may be retained, and is slideable within, the slot 156.

The elastic ropes 120 are configured such that the body 80 may translate from the impact position to the retracted position in the first direction (indicated by arrow "B" in FIGS. 2 to 5) along the operational axis 32 towards the mounting member 64 end of the power tool 30, along the rods 62 under the action of the actuator 82 (i.e. when coupled to the actuator) and against the force developed by the elastic ropes 120. Hence, when uncoupled from the actuator 80, and thus released from the retracted position (shown in FIG. 5), the body 80 is biased (i.e. urged) by the ropes 120 to move in the second direction (indicated by arrow "C" in FIGS. 2 to 5) along the operational axis 32, travelling on the rods 62, towards the impact position defined by the head 40 of the tool carrier 34 (shown in FIG. 4).

As shown in FIGS. 3 to 5, 8, 9 and 13, a first damper 170 is provided between the coupling member 66 and the tool carrier 34. FIG. 13 omits the detail of the first casing module 50 for clarity. The first damper 170 is provided between the coupling member 66 and the web plate 56 of the tool carrier 34. The first damper 170 may comprise at least two damping members 172 in series along the operational axis 32. In the examples shown there are provided seven damping members 172, each being provided as a ring of resilient material. At least one of the damping members 172 may have a different stiffness to one of the other damping members 172. In alternative examples, a different number of damping members 172 may be provided.

As shown in FIGS. 3 to 5, 8, 9 and 13, a second damper 180 is provided between the tool carrier 34 and a foot end of the first casing module 50. In particular the second damper 180 is provided between the tool carrier web plate 56 and a foot end of the first casing module 50. The second damper 180 comprises at least one fluid damper. The fluid damper(s) may be provided in the form of a pneumatic or hydraulic ram.

The power tool is operable to apply a percussive force to an object, for example a mass of masonry or a structure to be broken up.

In normal operation, a tool 36 is attached to the tool carrier 34, and the tool 36 is pressed into contact with a substantial mass/object. The clutch 110 is engaged to couple the body and actuator 82. The actuator 82 then draws the body 80 to the retracted position in the first direction (indicated by arrow "B" in FIGS. 2 to 5) along the rods 62, and hence along the operational axis 32, towards the mounting member 64 end of the power tool 30. In doing so, the actuator 80 extends the elastic ropes 120.

When retracted to a predetermined position, (as shown in FIG. 5), the clutch 110 is released such that the body 80 is uncoupled from the actuator 80, and thus released from the retracted position.

The body 80 is then drawn at high speed by the ropes 120 to move in the second direction (indicated by arrow "C" in FIGS. 2 to 5) along the rods 62, and hence along the operational axis 32, towards the impact position defined by the head 40 of the tool carrier 34, as shown in FIG. 4.

The force is transmitted by the tool carrier 34 to the tool 36, and hence the object to be broken up. The actuator 82 is then extended towards the body 80 so that the clutch 110 couples the body 80 and actuator 82, and the cycle starts again.

In the event that the tool 36 is not in contact with a target, for example if the target has collapsed and/or the position of the target has shifted relative to the tool, it is possible for a "misfire" to occur. In such a scenario the body 80 strikes the tool carrier 34, and the tool carrier 34 is moved along rods 62, but the tool has no target to impart the force to.

In such a scenario, the web 56 of the tool carrier 34 strikes the second damper 180, placed as it is between the tool carrier web 56 and the first casing module, and the force is absorbed by the second damper 180. If only some of the impact energy has been absorbed, the tool carrier 34 may then rebound back along rods 62 and operational axis 32, such that the web 56 collides with the first damper 170 to absorb a further proportion of the energy. The tool carrier 34 may rebound further to strike the shock absorber 180, and again bounce back to hit the first damper 170 until all of the energy imparted to the tool carrier 34 is absorbed.

Thus the first damper 180 at the foot end of the power tool 30 arrests movement of the tool carrier 34 when no load is applied to the tool 36. In the example shown the first damper 180 is provided as a shock absorber 180, as described above. This is advantageous over, and not equivalent to, a solid rubber damper, since a ram-type shock absorber is compressed over a greater distance, and thus absorbs energy over a longer time period, which thus provides additional damping. Additionally, multiple shock absorbers, as shown in the device of the present disclosure, provide greater damping ability than, for example, a rubber shock absorber block.

Figure 1:
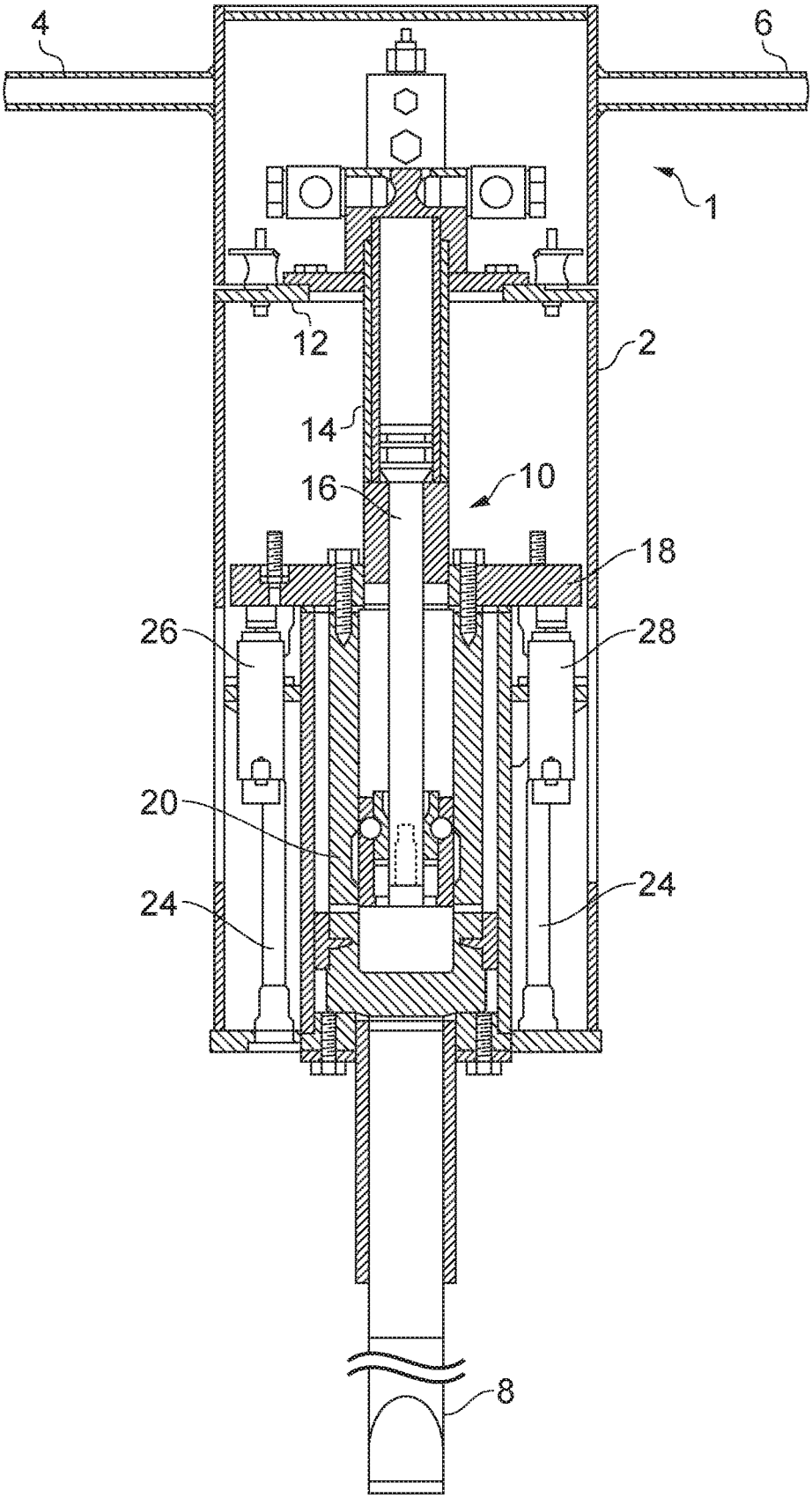
FIG. 1 shows an example of the related art, as described earlier.

A device of the present disclosure is thus advantageous since it provides a device having a substantially greater energy output per unit weight than either a purely pneumatic drill or the device as shown in FIG. 1. Hence masonry cutting operations take less time to perform with a device of the present disclosure. Thus any device powering or manoeuvring the tool (for example a backhoe loader) can move off station sooner, hence use less fuel and reduce noise pollution.

Since the power tool 30 of the present disclosure is inherently more efficient, the carrier vehicle, which provides power to the tool 30, may operate at a lower engine power setting than would be required with a power tool of the related art, thereby extending the life of the carrier vehicle, and reducing fuel consumption.

In examples where the actuator 82 is operated by hydraulic fluid delivered from a carrier vehicle, a power tool according to the present invention will require less work to be done by the fluid, and expose the fluid to less vibration, thus extending the life of the hydraulic fluid.

Additionally the multiple (i.e. four) rod 62 support structure, in combination with passages for the rods extending the full length of the body 80, provides an improved bearing surface for the body 80 to slide along, increases stability of body 80 as it moves along the rods 42, and hence decreases vibration during the impact and retraction strokes.

Additionally the body 80 is made as large as possible for the volume available in the casing of the power tool, thereby providing a larger momentum, and hence force, to strike the tool carrier 34.

The power tool of the present disclosure also includes an advantageous damping system including a first damper 170 and second damper 180 which are operable to absorb shock loads imparted to the tool carrier 34 during a misfire. This is extremely important as it prevents vibration and loads being transmitted to the casing of the power tool 30 and hence to the vehicle carrying the power tool 30. Since the carrier vehicle is exposed to less vibration and shock loads, the life of its components are increased. Additionally, the operator of the carrier vehicle is more comfortable, and hence can operate the device more effectively.

The fins 54 in conjunction with the grooves 52 of the tool carrier and casing 50 respectively prevent the tool carrier 34 from twisting relative to the power tool. That is to say, the fins 54 in conjunction with the grooves 52 of the tool carrier and casing 50 respectively prevent the tool carrier 34 from twisting relative to the casing modules of the power tool and, since the casing modules are non-rotatable around the operational axis 32, prevent the tool carrier 34 from twisting relative to the operational axis 32. This is extremely advantageous as it ensures a correct orientation of the end of the tool 36 attached to the tool carrier 34.

The modular nature of the power tool 30 makes it easier to assemble, re-configure and maintain.

The tool carrier 34 also allows for easy replacement of tools 36, for example to achieve a different cutting operation, or to replace a damaged tool 36.

Although the figures of the present application show a jack hammer type tool, the power tool of the present disclosure may form part of any power tool where it is required to deliver a cyclic percussive force to a target object.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A power tool having an operational axis, the power tool comprising:
- a tool carrier for mounting an impact tool, the tool carrier comprising:
  - a base member aligned with an operational axis of the power tool, the base member having:
    - a head end for receiving impact energy; and
    - a foot end at an opposite end of the tool carrier, the foot end being provided with a tool mount configured to transmit the impact energy to a tool; and
  - a tool carrier casing engagement feature provided between the head end and the foot end; and
- a first casing module, at least part of the tool carrier being located within the first casing module,
- the first casing module being provided with a tool carrier engagement feature complementary in shape to, and for interlocking engagement with, the tool carrier casing engagement feature,
- wherein:
  - the interlocking engagement between the tool carrier engagement feature and the tool carrier casing engagement feature (1) prevents rotation of the tool carrier around the operational axis, and (2) permits relative movement along the operational axis; and
  - the tool carrier casing engagement feature comprises:
    - a web plate that extends around a circumference of the base member; and
    - a plurality of fins that
      - extend from the web plate, and
      - extend longitudinally such that, in use, the plurality of fins are aligned with the operational axis of the power tool.

2. The power tool as claimed in claim 1, wherein the plurality of fins extend in a radially outward direction from the operational axis of the power tool.

3. The power tool as claimed in claim 2, wherein:

the tool carrier engagement feature of the first casing module is provided as grooves configured to receive one of the fins of the tool carrier casing engagement feature, the grooves are aligned with the operational axis of the power tool, and the grooves are configured to permit the tool carrier to move relative to the first casing module along the operational axis.

4. The power tool as claimed in claim 1, further comprising an actuator module centered on the operational axis, the actuator module having:

a plurality of rods held in a fixed relationship to one another by:

a mounting member toward a first end of the rods, and a coupling member spaced apart from the mounting member toward an opposite second end of the rods;

the actuator module being coupled to the first casing module via the coupling member; and the coupling member including an aperture through which the head end of the tool carrier extends.

5. The power tool as claimed in claim 4, wherein:

a second casing module extends between the mounting member and the coupling member.

6. The power tool as claimed in claim 5, wherein the actuator module further comprises:

a body, and an actuator for moving the body along the operational axis of the power tool between an impact position at which the body is operable to transfer impact energy to the head of the tool carrier, and a retracted position distal to the impact position and proximate to the mounting member.

7. The power tool as claimed in claim 6, wherein the actuator comprises a housing which extends from a carrier mount end of the power tool along the operational axis part way along the length of the second casing module within a volume defined between the plurality of rods.

8. The power tool as claimed in claim 6, wherein the body defines passages in slideable engagement with at least some of the rods, and configured such that the body translates between the impact position and the retracted position along the at least some of the rods.

9. The power tool as claimed in claim 6, wherein the body has a greater mass than a combined mass of an assembly of the tool carrier and the tool.

10. The power tool as claimed in claim 6, wherein the body has a greater mass than a mass of the tool carrier.

11. The power tool as claimed in claim 6, further comprising an array of elastic ropes, a first end of the array of elastic ropes being coupled to the body, and a second opposite end of the array of elastic ropes being coupled to the coupling member;

the array of elastic ropes being configured such that the body translates from the impact position to the retracted position in a first direction along the at least some of the rods under the action of the actuator and against a force developed by the array of elastic ropes; and the body being biased to move in a second direction along the at least some of the rods toward the impact position from the retracted position by the array of elastic ropes, while uncoupled from the actuator.

12. The power tool as claimed in claim 11, wherein the array of elastic ropes are coupled via a direct load transmission path to the coupling member and to the body.

13. The power tool as claimed in claim 11, wherein at least one rope of the array of elastic ropes comprises a solid rubber core member.

14. The power tool as claimed in claim 11, wherein:

at least one rope of the array of elastic ropes is provided with a body end cap at a first end of the at least one rope for engagement with the body; and a coupling member end cap at a second opposite end of the at least one rope for engagement with the coupling member, a largest external diameter of the body end cap being greater than a largest external diameter of the coupling member end cap.

15. The power tool as claimed in claim 14, wherein the body end cap and the coupling member end cap are joined to the at least one rope of the array of elastic ropes by an adhesive.

16. The power tool as claimed in claim 14, wherein the body comprises a rope passage which extends from a head end of the body to a foot end of the body, and the at least one rope of the array of elastic ropes extends through the rope passage.

17. The power tool as claimed in claim 16, wherein the head end of the rope passage comprises a restriction having an internal diameter that is configured to be less than a largest external diameter of the body end cap, and greater than a largest external diameter of the coupling member end cap, such that, during assembly, the coupling end cap and the at least one rope of the array of elastic ropes is entered in the head end of the rope passage, passed along the rope passage, and extended out of the foot end of the rope passage, so that the body end cap is caught in the head end of the rope passage; and the coupling member end of the at least one rope of the array of elastic ropes is attached to the coupling member.

18. The power tool as claimed in claim 14, wherein the body end cap is tapered along a length of the body end cap.

19. The power tool as claimed in claim 14, wherein the second casing module comprises an access panel configured to enable access to the head end of the body to facilitate insertion and removal of the at least one rope of the array of elastic ropes in the rope passage.

20. The power tool as claimed in claim 14, wherein:

the coupling member end cap of the at least one rope of the array of elastic ropes comprises a locking shoulder;

the coupling member comprises rope apertures through which the coupling member end cap extends;

the coupling member further comprises slots which extend from the rope apertures to a radially outer surface of the coupling member; and each of the slots is provided with a locking fork which is slideable within the each of the slots such that when the coupling member end cap extends through one of the rope apertures in the coupling member, the locking fork is slideable to engage with the locking shoulder to lock the coupling member end cap to the coupling member, and the locking fork is slideable to disengage with the locking shoulder to release the coupling member end cap from the coupling member.

21. The power tool as claimed in claim 20, wherein:

the each of the slots in the coupling member slot has a first region having a first width radially inward of a second region having a second width narrower than the first width, and the locking fork has a main body region and a neck region, the second region of the each of the slots being narrower than the main body region of the locking fork, such that the locking fork is retained and slideable within the each of the slots.

22. The power tool as claimed in claim 4, wherein a first damper is provided between the coupling member and the tool carrier.

23. The power tool as claimed in claim 22, wherein the first damper comprises at least two damping members in series along the operational axis.

24. The power tool as claimed in claim 23, wherein the at least two damping members have different stiffness with respect to one another.

25. The power tool as claimed in claim 22, wherein a second damper is provided between the tool carrier and a foot end of the first casing module.

* * * * *